US006953516B2

(12) United States Patent
Hermans et al.

(10) Patent No.: US 6,953,516 B2
(45) Date of Patent: Oct. 11, 2005

(54) PROCESS FOR MAKING THROUGHDRIED TISSUE BY PROFILING EXHAUST GAS RECOVERY

(75) Inventors: Michael Alan Hermans, Neenah, WI (US); Frank Stephen Hada, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 75 days.

(21) Appl. No.: 10/760,072

(22) Filed: Jan. 16, 2004

(65) Prior Publication Data

US 2005/0155734 A1 Jul. 21, 2005

(51) Int. Cl.[7] ..... D21F 11/00; D21F 5/18

(52) U.S. Cl. ..... 162/198; 162/189; 162/207; 34/452; 34/513; 700/129

(58) Field of Search ..... 162/189–190, 162/198–199, 207, 109, 111, 118, 290, 297; 34/86, 122–12, 452, 513, 604, 629; 700/127–129

(56) References Cited

U.S. PATENT DOCUMENTS

| | | | | |
|---|---|---|---|---|
| 3,303,576 | A * | 2/1967 | Sisson | 34/115 |
| 3,447,247 | A * | 6/1969 | Daane | 34/122 |
| 3,849,904 | A * | 11/1974 | Villatobos | 34/636 |
| 4,238,284 | A * | 12/1980 | Huostila et al. | 162/207 |
| 4,242,808 | A * | 1/1981 | Luthi | 34/459 |
| 4,462,868 | A * | 7/1984 | Oubridge et al. | 162/280 |
| 4,523,390 | A * | 6/1985 | McCarthy | 34/115 |
| 5,306,395 | A * | 4/1994 | Myren | 162/301 |
| 5,397,437 | A * | 3/1995 | Myren | 162/203 |
| 5,603,806 | A * | 2/1997 | Kerttula | 162/198 |
| 5,771,174 | A * | 6/1998 | Spinner et al. | 700/129 |
| 5,784,801 | A * | 7/1998 | Thorp et al. | 34/115 |
| 5,974,691 | A * | 11/1999 | Marchal et al. | 34/456 |
| 6,551,461 | B2 * | 4/2003 | Hermans et al. | 162/207 |
| 6,560,893 | B1 * | 5/2003 | Bakalar | 34/110 |
| 6,743,334 | B2 * | 6/2004 | Klerelid et al. | 162/118 |
| 6,797,115 | B2 * | 9/2004 | Klerelid et al. | 162/111 |
| 2003/0019601 | A1 * | 1/2003 | Hermans et al. | 162/207 |
| 2003/0115773 | A1 * | 6/2003 | Lin et al. | 34/444 |

FOREIGN PATENT DOCUMENTS

| | | | | |
|---|---|---|---|---|
| EP | 745723 | A2 * | 12/1996 | D21F 1/08 |
| GB | 2006296 | A * | 5/1979 | D21F 11/00 |
| WO | WO 9105105 | A1 * | 4/1991 | D21G 9/00 |

* cited by examiner

*Primary Examiner*—José A. Fortuna
(74) *Attorney, Agent, or Firm*—Gregory E. Croft

(57) ABSTRACT

The energy efficiency of a throughdrying papermaking process is improved by recycling exhaust gas from one or more throughdryers prior to throughdrying to profile the consistency of the web.

21 Claims, 7 Drawing Sheets

PROCESS FOR MAKING THROUGHDRIED TISSUE BY PROFILING EXHAUST GAS RECOVERY

BACKGROUND OF THE INVENTION

In the manufacture of tissue products such as facial tissue, bath tissue, paper towels and the like, it is common to use one or more throughdryers to bring the paper web to final dryness or near-final dryness. Generally speaking, throughdryers are rotating cylinders having an open deck that supports a drying fabric which, in turn, supports the web being dried. Heated air is provided by a hood above the drying cylinder and is passed through the web while the web is supported by the drying fabric. During this process, the heated air is cooled while increasing in moisture. This spent air is exhausted from the interior of the drying cylinder via a fan that pulls the air through the web and recycles it to a burner. The burner reheats the spent air, which is then recycled back to the throughdryer. To complete the process, a portion of the exhaust air is removed and a proportional amount of fresh, dry air is pulled into the system to avoid a build-up of moisture in the drying air system. Normally, the portion of the exhaust air that is removed is either vented or used to heat process water.

Recently, it has been disclosed that the exhaust gas from the throughdryer(s) can be recycled to recover heat value that would otherwise be wasted. Such processes are disclosed in U.S. Pat. No. 6,551,461 B2, issued Apr. 22, 2003 to Hermans et al. and entitled "Process For Making Throughdried Tissue Using Exhaust Gas Recovery", which is herein incorporated by reference. While such processes are a significant improvement in cost reduction, there are still needs for further improvements while at the same time improving product quality.

SUMMARY OF THE INVENTION

It has now been discovered that the energy efficiency of throughdrying can be further improved by recycling exhaust gas from the throughdryer(s) and using the exhaust gas to "profile" the consistency of the wet web prior to throughdrying. As used herein, the term "profile" or "profiling" means that the moisture content, temperature, velocity and/or flow rate of any gas being introduced to the tissue web is controllably varied across the web in the cross-machine direction in order to control the consistency (percent dry fiber content) of the wet web entering the throughdryer, preferably to make the consistency of the web more uniform. Providing a more uniform consistency within the web improves the efficiency of the throughdrying operation and can improve product quality. More uniform consistency can be useful by allowing the tissue manufacturer to increase the average final moisture of the web, thus saving energy. More uniform moisture is also useful for increasing the efficiency of converting operations by producing more uniform product quality.

To this end, a variety of different profiling means in accordance with this invention are possible. For example, in one embodiment, an exhaust gas recovery plenum can be provided with a plurality of independent gas passages in the cross-machine direction, the flow through which is individually and independently controlled by flow dampers. In another embodiment, the exhaust gas recovery plenum can be provided with or positioned adjacent to a plurality of independently controlled steam or water nozzles in the cross-machine direction to add moisture to the web where needed. In another embodiment, the exhaust gas recovery plenum can be used in cooperation with a profiling vacuum box positioned below the web. The profiling vacuum box is provided with a plurality of independent gas passages in the cross-machine direction of the box, the flow through which is individually and independently controlled by flow dampers. In a further embodiment, an exhaust gas recovery plenum with profiling capability can be used in combination with a vacuum box with profiling capability to provide added flexibility and profile control. In such cases, the number of profiling flow channels in the exhaust gas recovery plenum and the vacuum box can be the same or different.

Rather than applying moisture directly to the web, it is also possible to treat the exhaust air after it has been separated into profiling zones, but before it reaches the web so as to alter the moisture content of the air and temperature which will in turn change the amount of profiling occurring when the exhaust air contacts the web.

Hence, in one aspect, the invention resides in a process for making tissue comprising: (a) forming a wet tissue web by depositing an aqueous suspension of papermaking fibers onto a forming fabric; (b) partially dewatering the wet tissue web while the wet tissue web is supported by a papermaking fabric; (c) drying the wet web in one or more throughdryers, wherein heated drying gas gathers moisture from the wet web as it is passed through the wet web and is exhausted from the throughdryer(s); (d) winding the dried web into a roll; and (e) recycling exhaust gas from one or more of the throughdryers to control the cross-directional consistency and/or temperature profile of the web at a point in the process after the web is formed and before the web is dried.

If two, three, four or more throughdryers are used in series, the moisture content of the exhaust gas from each of the throughdryers can be different. Therefore, as used herein, a "primary" throughdryer is the throughdryer having the exhaust gas with highest moisture content. Other throughdryers are considered to be "secondary" throughdryers. In most instances where two throughdryers are being used, it is advantageous that the exhaust gas from the first throughdryer be recycled to the exhaust gas recovery plenum because the first throughdryer is normally the primary throughdryer. However, should the two throughdryers be operated in a manner that reverses the relative moisture contents such that the second throughdryer becomes the primary throughdryer, then the second throughdryer exhaust gas could advantageously be used for the profiling operation rather than the exhaust gas from the first throughdryer. Of course, if only one throughdryer is used that is equipped with one drying system, then the sole throughdryer is the primary throughdryer. Optionally, the exhaust gas from the second throughdryer or other secondary throughdryers, which generally has a lower moisture content and higher temperature, can also be used to profile the dewatered web prior to entering the primary throughdryer in order to further improve energy efficiency.

When exhaust gas from more than one throughdryer is used to profile the web, the exhaust gases can be used independently in sequential profiling operations, or they can be used to feed separate flow channels within a single profiling operation, or they can be combined into one or more flow channels within a single profiling operation to provide the optimum gas properties for the particular profiling situation. More specifically, it can be advantageous to direct the exhaust gas from the primary throughdryer to the areas of the web where the consistency is the lowest and direct the exhaust gas from the secondary throughdryer to the areas of the web where the consistency is the highest in order to even out the cross-machine direction consistency profile.

Suitable locations to introduce throughdryer exhaust gas to the dewatered web include any point after the web has been formed and before the web contacts the throughdrying cylinder. Such locations can be while the web is supported by the forming fabric, the transfer fabric (if present) and/or while the web is in contact with the throughdryer fabric.

If multiple vacuum boxes are used to dewater the web prior to the throughdrying step, it is advantageous to position the exhaust gas recovery plenum over the vacuum box with the largest flow to take advantage of the large volume of air associated with the exhaust. The flow is determined by the combination of the open area of the vacuum slot or opening and the vacuum level in the particular vacuum box. Increased flow means more recovered steam and hence more dewatering. However, the exhaust gas recovery plenum can be positioned over two or more vacuum boxes if desired.

For profiling purposes, the number of profiling channels or nozzles, as the case may be, can be about one for each 1–12 inches of sheet across the width of the web. In other words, each profiling channel can be used to affect anywhere from about 1 inch of sheet to 12 inches of sheet in the cross-machine direction of the web. Hence for a 200 inches wide sheet, the number of profiling channels or nozzles could range from about 17 to about 200.

The profiling zones serve to even out any unevenness in the moisture profile of the sheet that is present as it enters the profiling device. Specifically, the uniformity of the cross-machine direction consistency profile can be increased by about 2 percent or greater, more specifically about 4 percent or greater, and still more specifically about 6 percent or greater. As used herein, increasing the uniformity of the consistency profile by a certain percentage means that the consistency itself is changed a certain percent in absolute terms. By way of example, if the difference between the highest consistency and the lowest consistency of the profile starts out at 10 percent, increasing the uniformity by 2 percent would mean that the resulting difference between the highest consistency and the lowest consistency is reduced to 8 percent. The cross-machine direction moisture profile prior to profiling may have any value (i.e. the range of moisture values may vary from the mean by any amount). However, after the profiling in accordance with this invention, the range of the moisture profile in the cross-machine direction should be the mean value plus or minus 2–4% consistency (i.e. if the mean consistency is 25%, the highest and lowest values at any point across the web would be 27–29% and 21–23%, respectively). Note that this range of moisture profile applies to the portion of the web which is retained and converted. Typically the very edges of any web produced on a tissue machine will have a wider range due to edge effects, but this portion of the web may be trimmed at some point in the process and discarded or recycled.

It will also be appreciated that the profiling method of this invention can be automatically adjusted by using the feedback from a scanning system such as those manufactured by ABB Corporation. The moisture profile can be analyzed and the settings of the profiling system of this invention can be automatically or manually adjusted to minimize the range of variation in moisture. Alternatively, the cross-machine direction temperature profile of the profiled web can be measured (using a thermographic camera, for example) and used to control the consistency profiling using a feedback control loop.

DETAILED DESCRIPTION OF THE DRAWINGS

Referring to the figures, the invention will be described in greater detail. Unless otherwise stated, like reference numbers refer to like features when used in more than one figure.

Figure 1:
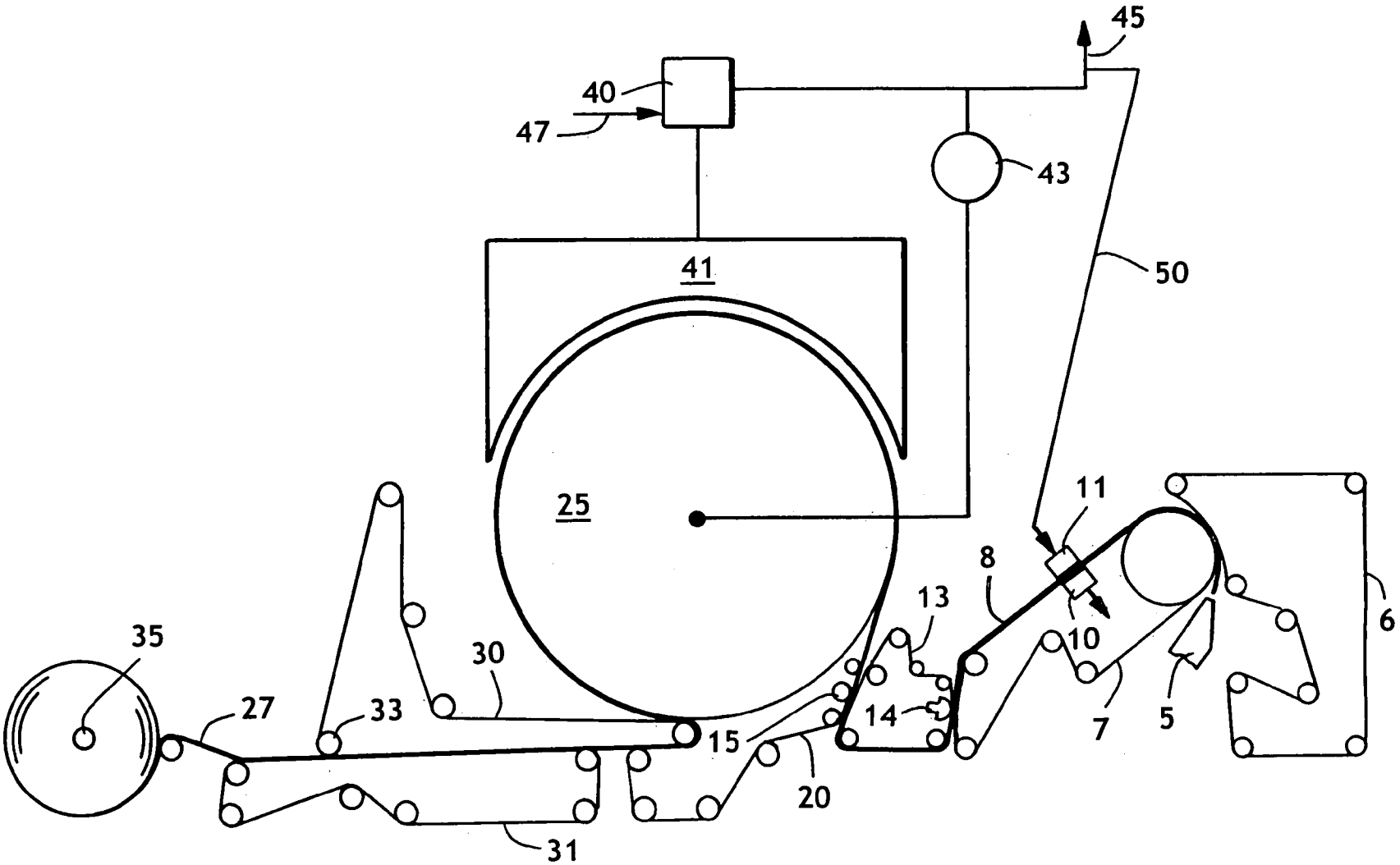
FIG. 1 is a schematic process flow diagram of a throughdrying process in accordance with this invention, illustrating an uncreped throughdrying process with only one throughdryer.

FIG. 1 illustrates one of many papermaking processes to which the invention is applicable. Shown is an uncreped throughdried tissue process in which a twin wire former having a layered papermaking headbox 5 injects or deposits a stream of an aqueous suspension of papermaking fibers between two forming fabrics 6 and 7. Forming fabric 7 serves to support and carry the newly-formed wet web 8 downstream in the process as the web is partially dewatered to an appropriate consistency, such as about 10% dry weight percent. As shown in this example, profiling of the web in accordance with this invention takes place at the point in the process where the exhaust gas recovery plenum 11 and the vacuum box(es) 10 are positioned. Additional dewatering of the wet web can be carried out, such as by vacuum suction, using one or more steam boxes in conjunction with one or more vacuum suction boxes (not shown) while the wet web is supported by the forming fabric 7.

The wet web 8 is then transferred from the forming fabric 7 to a transfer fabric 13 traveling at a slower speed than the forming fabric in order to impart increased MD stretch into the web. The transfer is carried out to avoid compression of the wet web, preferably with the assistance of a vacuum shoe 14. Although not shown, it is within the scope of this invention for the profiling to take place at any point while the web is supported by the transfer fabric as well as the forming fabric.

The web is then transferred from the transfer fabric 13 to the throughdrying fabric 20 with the aid of a vacuum transfer roll 15 or a vacuum transfer shoe. Transfer is preferably carried out with vacuum assistance to ensure deformation of the sheet to conform to the throughdrying fabric, thus yielding desired bulk, flexibility, CD stretch and appearance.

The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric 20, the web is dried to a final consistency, typically about 94 percent or greater, by the throughdryer 25 and thereafter transferred to a carrier fabric 30. The dried basesheet 27 is transported to the reel 35 using carrier fabric 30 and an optional carrier fabric 31. An optional pressurized turning roll 33 can be used to facilitate transfer of the web from carrier fabric 30 to fabric 31. Although not shown, reel calendering or subsequent off-line calendering can be used to improve the smoothness and softness of the basesheet.

The hot air used to dry the web while passing over the throughdryer is provided by a burner 40 and distributed over the surface of the throughdrying drum using a hood 41. The air is drawn through the web into the interior of the throughdrying drum via fan 43 which serves to circulate the air back to the burner. In order to avoid moisture build-up in the system, a portion of the spent air is vented 45, while a proportionate amount of fresh make-up air 47 is fed to the burner. The exhaust gas recycle stream 50 provides exhaust gas to the exhaust gas recovery plenum 11 operatively positioned in the vicinity of one or more vacuum suction boxes 10, such that exhaust gas fed to the exhaust gas recovery plenum is drawn through the web, through the papermaking fabric and into the vacuum box(es) in order to control the consistency profile the web. The humidity of the recycled exhaust gas can be about 0.15 pounds of water vapor or greater per pound of air, more specifically about 0.20 pounds of water vapor or greater per pound of air, and still more specifically about 0.25 pounds of water vapor or greater per pound of air.

Figure 2:
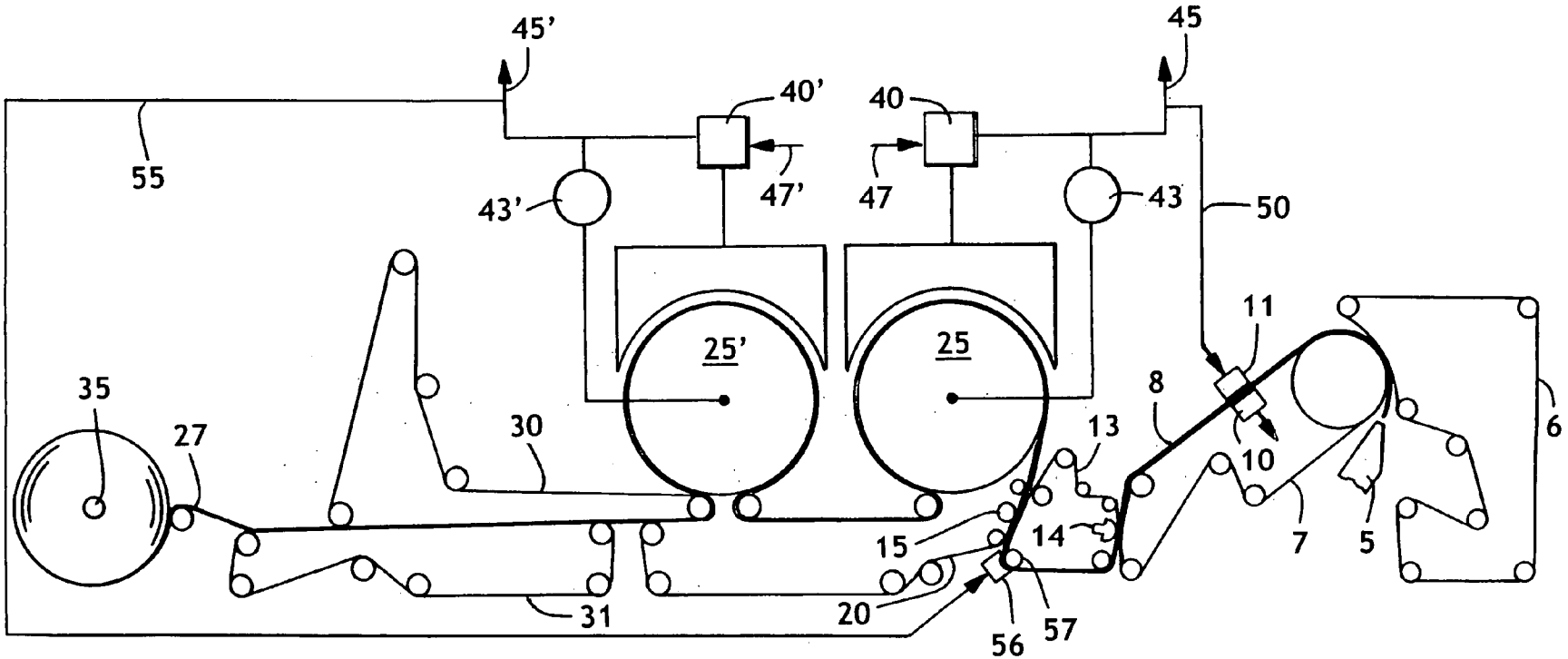
FIG. 2 is a schematic process flow diagram of a throughdrying process in accordance with this invention, illustrating an uncreped throughdrying process having two throughdryers in series.

FIG. 2 is a schematic process flow diagram of another throughdrying process in accordance with this invention, similar to that illustrated in FIG. 1, but in which two throughdryers are used in series to dry the web. The components of the second throughdryer are given the same reference numbers used for the first throughdryer, but distinguished with a "prime". When two throughdryers are used as shown, the exhaust gas from the first (primary) throughdryer is recycled to the exhaust gas recovery plenum 11 because of its relatively greater heat value. As previously noted, if the throughdryers are operated in such a fashion that the relative heat value of the second throughdryer is greater than the first for the given application, the exhaust gas from the second throughdryer can be used for the recycle stream to the exhaust gas recovery plenum 11.

Optionally, exhaust gas from the second throughdryer can be used to heat and/or profile the dewatered web by providing an exhaust gas recycle stream 55 which, as shown, is directed to exhaust gas recovery plenum 56 opposite vacuum roll or shoe 57. Any of the web-contacting or sheet-contacting rolls in the vicinity of vacuum roll or shoe 57 are also suitable locations for introducing the exhaust gas for purposes of profiling in accordance with this invention should these rolls be equipped with vacuum. As an alternative (not shown), a vacuum box can be placed within the loop of fabric 13 and the plenum 56 can be placed operatively opposite this vacuum box to profile the web.

Figure 3:
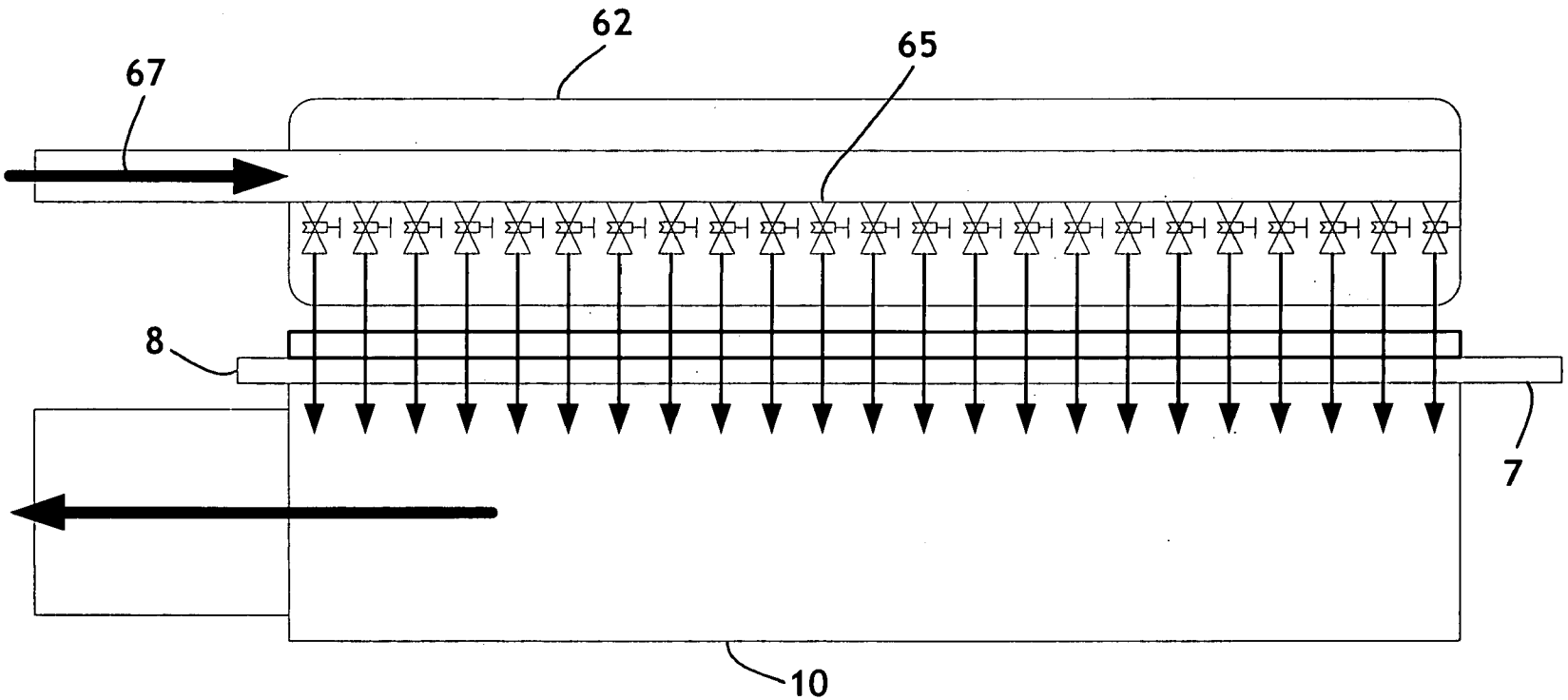
FIG. 3 (PRIOR ART)
FIG. 3 is a schematic diagram of a prior art steam box equipped with profiling valves.

FIG. 3 is a schematic drawing of a prior art steam box assembly used for profiling purposes as viewed in the machine direction (which is into the paper). Shown is the newly-formed web 8 supported by the forming fabric 7. The vacuum box 10 is positioned directly below a steam box 62. Spanning the cross-machine direction of the web, multiple profiling valves 65 are independently controlled to control the flow of steam from the steam header 67 through the web. The flow of steam is indicated by the arrows. No recovered throughdryer exhaust gas is utilized.

Figure 4:
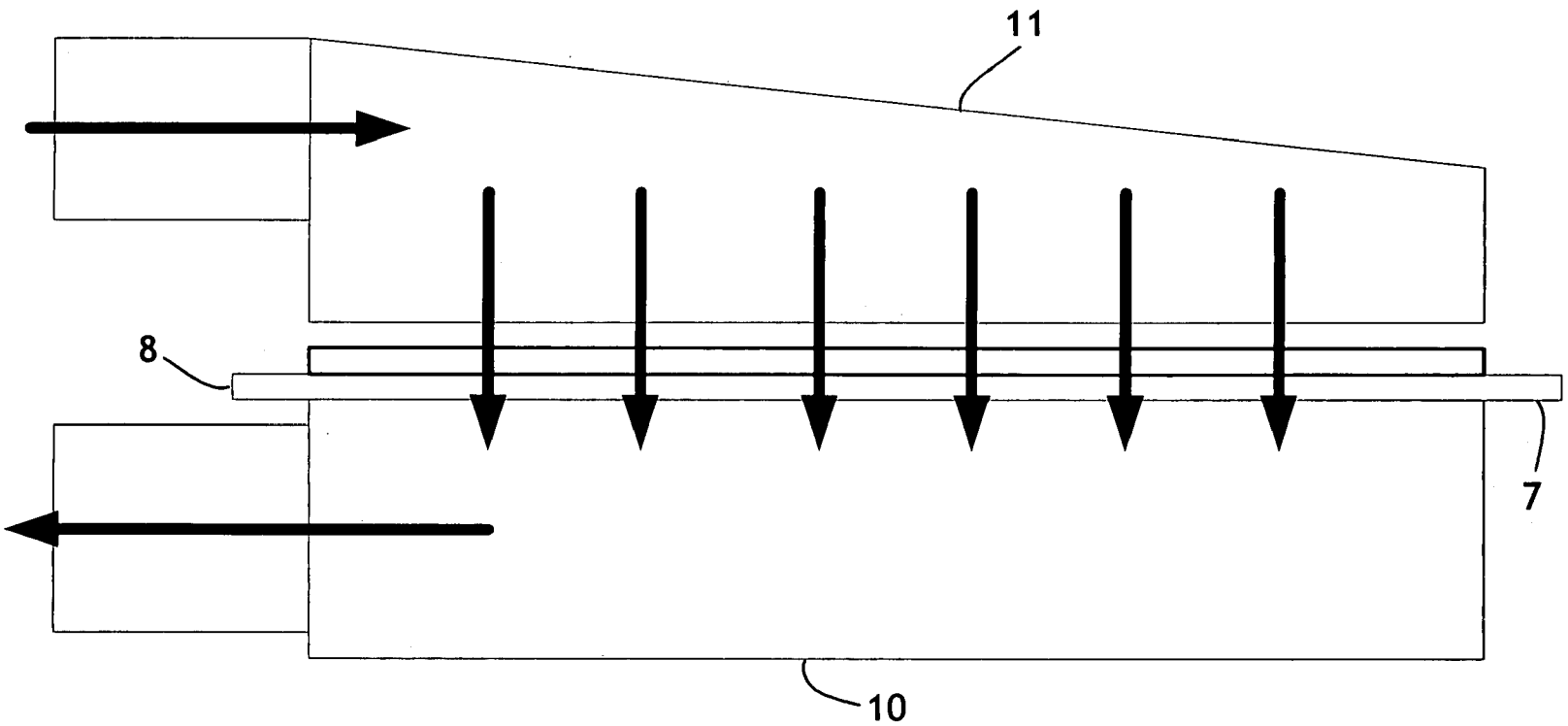
FIG. 4 (PRIOR ART)
FIG. 4 is a schematic diagram of a prior art waste heat supply plenum or header.

FIG. 4 is a schematic drawing of a prior art exhaust gas recovery plenum used in conjunction with a typical vacuum box. No profiling of the web consistency is carried out. Shown is the wet web 8 supported by the forming fabric 7. Above the web is the exhaust gas recovery plenum 11 which collects exhaust and feeds it to the vacuum box 10 positioned below the fabric. Air flow is indicated by the arrows.

Figure 5:
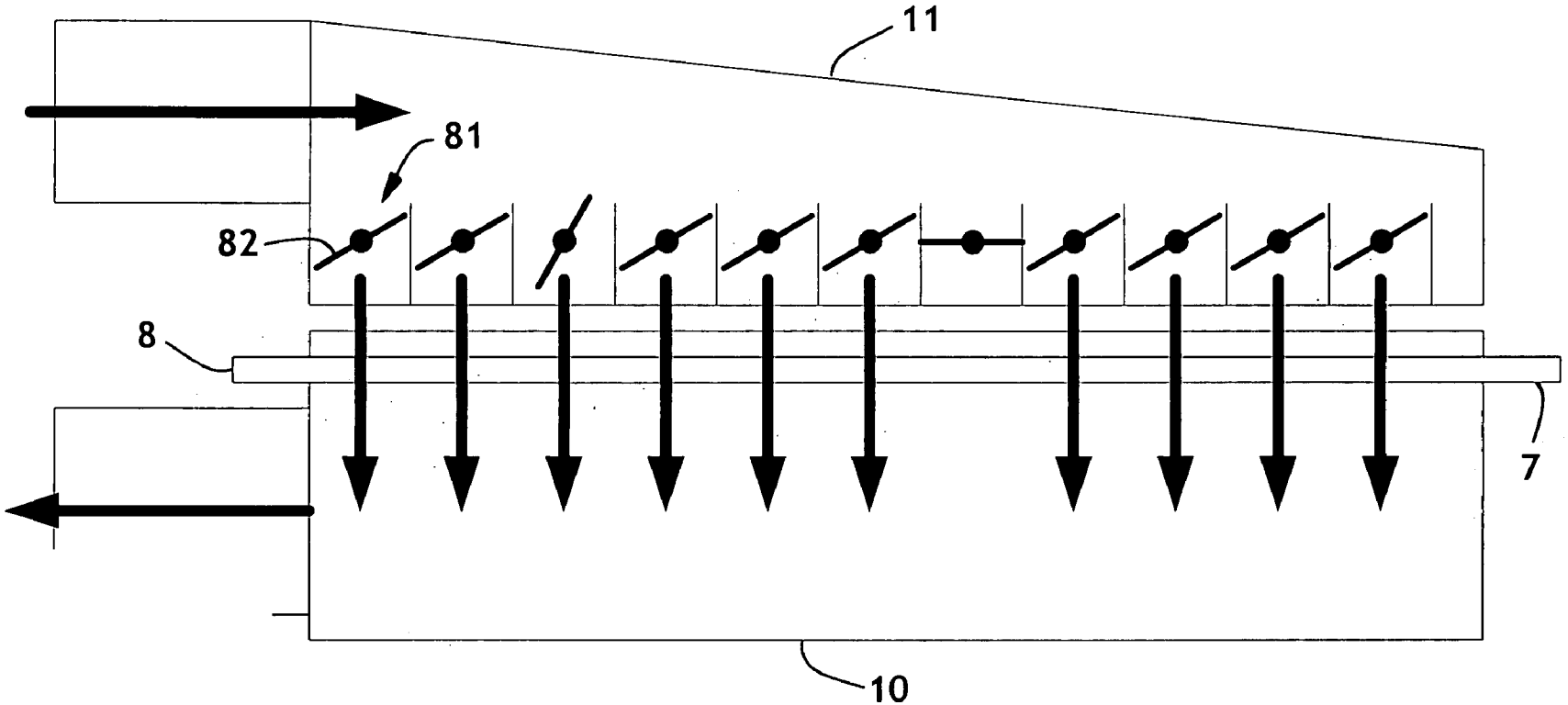
FIG. 5 is a schematic diagram of a profiling supply plenum for use in accordance with this invention.

FIG. 5 illustrates a profiling using a modified exhaust gas recovery plenum 11 used in conjunction with a vacuum box 10 in accordance with this invention. Flow is indicated by the arrows. Within the exhaust gas recovery plenum is a plurality of profiling flow channels 81, each of which contains a flow damper 82. For purposes of illustration, shown are eleven profiling flow channels spanning the cross-machine direction and eleven flow dampers. Counting from the left, the seventh flow damper is closed and the others are partially open. The third flow damper is more open than the others. Hence in operation, a slightly greater flow of recovered exhaust gas will pass through the web through the third profiling flow channel than the others. No recovered exhaust gas will flow through the seventh channel. This will decrease the consistency of the web at the seventh position. Simultaneously, the increased opening of the third damper will lead to greater flow in this area and hence increase the consistency of the web at this position. Note that the dampers can be manually adjusted, based on observed consistency results, or they can be automatically controlled by an actuator based on feedback from a cross-machine moisture profile sensor.

Figure 6:
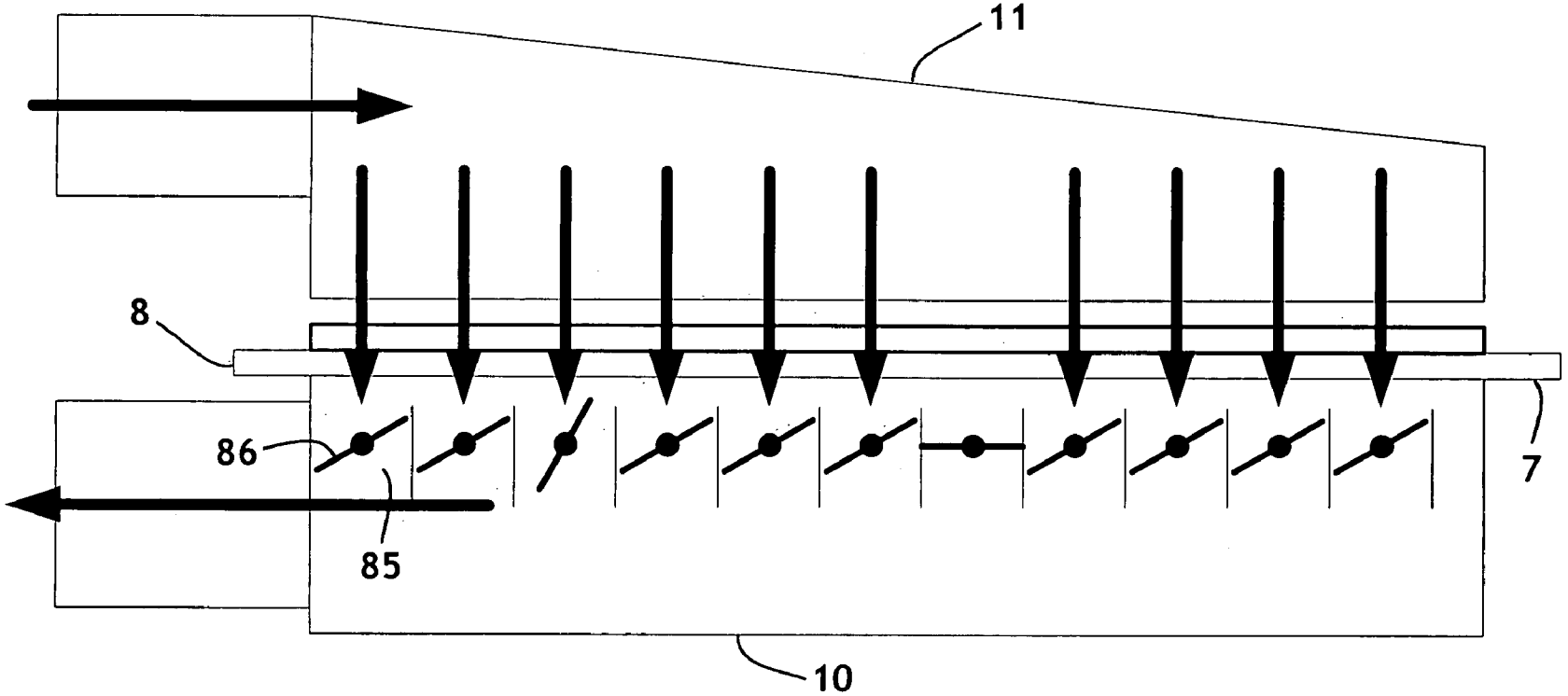
FIG. 6 is a schematic diagram of a profiling vacuum box for use in accordance with this invention.

FIG. 6 illustrates another embodiment of this invention, wherein an exhaust gas recovery plenum 11 is used in conjunction with a vacuum box 10 having profiling capability. More particularly, the vacuum box is provided with multiple flow channels 85, each containing a flow damper 86. The dampers are shown in the same positions as those of FIG. 5 and the effect on the profiling of the web would be expected to be the same as that realized by the profiling apparatus of FIG. 5.

Figure 7:
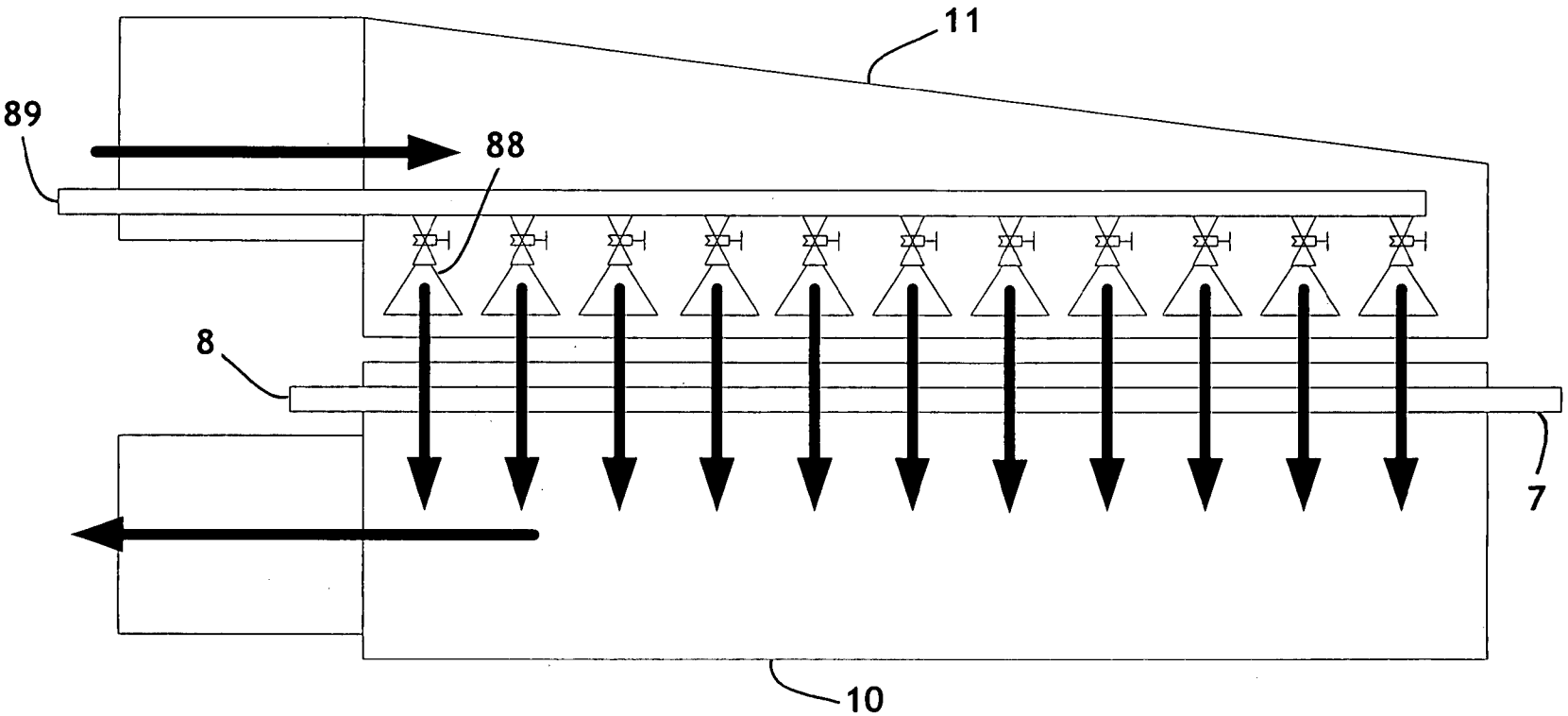
FIG. 7 is a schematic diagram of a profiling system using a waste heat supply plenum in conjunction with a series of water and/or steam nozzles.

FIG. 7 illustrates another embodiment of this invention in which the recovered exhaust gas is supplemented with spraying water or steam onto the web using a series of nozzles 88 supplied by header 89. The nozzles can be inside the exhaust gas recovery plenum, or they can be positioned adjacent (prior to or after) the exhaust gas recovery plenum in the process. The nozzles are individually and independently controlled, so the differential amount of moisture added to the web across its profile can be controlled.

It will be appreciated that the foregoing description, given for purposes of illustration, is not to be construed as limiting the scope of this invention, which is defined by the following claims and all equivalents thereto.

We claim:

1. A process for making tissue comprising: (a) forming a wet tissue web by depositing an aqueous suspension of papermaking fibers onto a forming fabric; (b) partially dewatering the wet tissue web while the wet tissue web is supported by a papermaking fabric; (c) drying the wet web in one or more throughdryers, wherein heated drying gas gathers moisture from the wet web as it is passed through the wet web and is exhausted from the throughdryer(s); (d) winding the dried web into a roll; and (e) recycling exhaust gas from one or more of the throughdryers to control the cross-machine directional consistency profile of the wet web at a point in the process after the web is formed and before the web is dried.

2. The process of claim 1 wherein all of the cross-machine direction moisture profile values are within ±2 percent of the mean consistency.

3. The process of claim 1 wherein all of the cross-machine direction moisture profile values are within ±4 percent of the mean consistency.

4. The process of claim 1 wherein the uniformity of the cross-machine direction consistency profile is increased by 2 percent or greater.

5. The process of claim 1 wherein the uniformity of the cross-machine direction consistency profile is increased by 4 percent or greater.

6. The process of claim 1 wherein the uniformity of the cross-machine direction consistency profile is increased by 6 percent or greater.

7. The process of claim 1 wherein the humidity of the recycled exhaust gas is 0.15 pounds of water vapor or greater per pound of air.

8. The process of claim 1 wherein the humidity of the recycled exhaust gas is 0.20 pounds of water vapor or greater per pound of air.

9. The process of claim 1 wherein the humidity of the recycled exhaust gas is 0.25 pounds of water vapor or greater per pound of air.

10. The process of claim 1 wherein exhaust gases from a primary throughdryer and a secondary throughdryer are used to control the cross-directional consistency profile, such that exhaust gas from the primary throughdryer is directed to areas of the web having the lowest consistency and exhaust gas from the secondary throughdryer is directed to areas of the web having the highest consistency.

11. The process of claim 1 where the recycled exhaust gas is used to increase the mean consistency of the web as well as control the cross-machine direction consistency profile.

12. The process of claim 1 wherein the recycled exhaust gas is directed to an exhaust gas recovery plenum and is thereafter drawn through the wet web by a vacuum box or vacuum roll.

13. The process of claim 12 wherein the exhaust gas recovery plenum comprises a plurality of independent gas passages spanning the cross-machine direction, the flow through which is individually and independently controlled by flow dampers.

14. The process of claim 13 wherein the exhaust gas is drawn through the wet web by a vacuum box which comprises a plurality of independent gas passages spanning the cross-machine direction of the box, the flow through which is individually and independently controlled by flow dampers.

15. The process of claim 14 wherein the number of gas passages in the exhaust gas recovery plenum is the same as the number of passages in the vacuum box.

16. The process of claim 14 wherein the number of gas passages in the exhaust gas recovery plenum is different than the number of passages in the vacuum box.

17. The process of claim 12 wherein the exhaust gas recovery plenum comprises a plurality of independently controlled steam or water nozzles spanning the cross-machine direction which differentially add moisture to the web.

18. The process of claim 12 wherein the exhaust gas recovery plenum is positioned adjacent to a plurality of independently controlled steam or water nozzles spanning the cross-machine direction which differentially add moisture to the web.

19. The process of claim 12 wherein the exhaust gas is drawn through the wet web by a vacuum box which comprises a plurality of independent gas passages spanning the cross-machine direction of the box, the flow through which is individually and independently controlled by flow dampers.

20. The process of claim 12 wherein the exhaust gas recovery plenum comprises a plurality of independent gas passages spanning the cross-machine direction and a plurality of independently controlled steam or water nozzles which add moisture to the flow of exhaust gas through one or more of the gas passages.

21. The process of claim 12 wherein the cross-machine direction temperature profile of the profiled web can be measured and used to control the consistency profiling using a feedback control loop.

* * * * *